US010006715B2

(12) United States Patent
Colannino et al.

(10) Patent No.: US 10,006,715 B2
(45) Date of Patent: Jun. 26, 2018

(54) TUNNEL BURNER INCLUDING A PERFORATED FLAME HOLDER

(71) Applicant: ClearSign Combustion Corporation, Seattle, WA (US)

(72) Inventors: Joseph Colannino, Bellevue, WA (US); Douglas W. Karkow, Des Moines, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 190 days.

(21) Appl. No.: 15/044,953

(22) Filed: Feb. 16, 2016

(65) Prior Publication Data

US 2016/0238318 A1 Aug. 18, 2016

Related U.S. Application Data

(60) Provisional application No. 62/117,403, filed on Feb. 17, 2015.

(51) Int. Cl.

| | |
|---|---|
| ***F27B 9/24*** | (2006.01) |
| ***F27B 9/26*** | (2006.01) |
| ***F27D 3/12*** | (2006.01) |
| ***F23D 14/14*** | (2006.01) |
| ***F23D 14/84*** | (2006.01) |
| ***F23D 14/70*** | (2006.01) |
| ***F23D 14/72*** | (2006.01) |

(52) U.S. Cl.

CPC ..... *F27B 9/2469* (2013.01); *F23D 14/14* (2013.01); *F23D 14/70* (2013.01); *F23D 14/725* (2013.01); *F23D 14/84* (2013.01); *F27B 9/262* (2013.01); *F27D 3/123* (2013.01); *F23N 2027/02* (2013.01); *F23N 2029/00* (2013.01)

(58) Field of Classification Search

CPC ..... F27B 2009/3638; F27D 99/0033; F27D 2003/161

See application file for complete search history.

(56) References Cited

U.S. PATENT DOCUMENTS

| | | | | |
|---|---|---|---|---|
| 4,021,188 | A | 5/1977 | Yamagishi et al. | |
| 4,174,951 | A * | 11/1979 | Bloom | F23D 14/02 236/15 BD |
| 4,408,461 | A | 10/1983 | Bruhwiler et al. | |
| 4,752,213 | A | 6/1988 | Grochowski et al. | |
| 5,248,255 | A * | 9/1993 | Morioka | F27B 9/2407 431/326 |
| 5,326,257 | A | 7/1994 | Taylor et al. | |

(Continued)

FOREIGN PATENT DOCUMENTS

| | | |
|---|---|---|
| EP | 2738460 | 6/2014 |
| GB | 1042014 | 9/1966 |

(Continued)

*Primary Examiner* — Gregory A Wilson

(74) *Attorney, Agent, or Firm* — Christopher A. Wiklof; Nicholas S. Bromer; Launchpad IP, Inc.

(57) ABSTRACT

A process oven includes a housing structure with a conveyor system configured to carry product through a housing structure from a first opening to a second opening. A perforated flame holder is positioned within the housing structure and configured to apply, to the product, thermal energy released by a combustion reaction held by the perforated flame holder.

34 Claims, 10 Drawing Sheets

(56) References Cited

U.S. PATENT DOCUMENTS 5,441,402 A 8/1995 Reuther et al.
5,641,282 A 6/1997 Lee et al.
5,718,573 A 2/1998 Knight et al.
5,906,485 A * 5/1999 Groff ..... A21B 1/48 432/121
6,159,001 A 12/2000 Kushch et al.
8,851,882 B2 10/2014 Hartwick et al.
8,881,535 B2 11/2014 Hartwick et al.
8,911,699 B2 12/2014 Colannino et al.
9,151,549 B2 10/2015 Goodson et al.
9,209,654 B2 12/2015 Colannino et al.
9,243,800 B2 1/2016 Goodson et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,190 B2 6/2016 Karkow et al.
9,377,195 B2 6/2016 Goodson et al.
9,388,981 B2 7/2016 Karkow et al.
2006/0141413 A1 6/2006 Masten et al.
2011/0076628 A1 3/2011 Miura et al.
2011/0111357 A1* 5/2011 Klobucar ..... B05D 3/0254 432/136
2012/0164590 A1 6/2012 Mach
2013/0071794 A1 3/2013 Colannino et al.
2013/0230810 A1 9/2013 Goodson et al.
2013/0260321 A1 10/2013 Colannino et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0011150 A1* 1/2014 Miyata ..... F27B 9/20 432/133
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0170577 A1 6/2014 Colannino et al.
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0248566 A1 9/2014 Krichtafovitch et al.
2014/0255855 A1 9/2014 Krichtafovitch
2014/0255856 A1 9/2014 Colannino et al.
2014/0272730 A1 9/2014 Krichtafovitch et al.
2014/0272731 A1 9/2014 Breidenthal et al.
2014/0287368 A1 9/2014 Krichtafovitch et al.
2014/0295094 A1 10/2014 Casasanta, III
2014/0295360 A1 10/2014 Wiklof
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0226424 A1 8/2015 Breidenthal et al.
2015/0241057 A1 8/2015 Krichtafovitch et al.
2015/0276211 A1 10/2015 Colannino et al.
2015/0276217 A1 10/2015 Karkow et al.
2015/0276220 A1 10/2015 Karkow et al.
2015/0285491 A1 10/2015 Karkow et al.
2015/0316261 A1 11/2015 Karkow et al.
2015/0330625 A1 11/2015 Karkow et al.
2015/0338089 A1 11/2015 Krichtafovitch et al.
2015/0345780 A1 12/2015 Krichtafovitch
2015/0345781 A1 12/2015 Krichtafovitch et al.
2015/0362177 A1 12/2015 Krichtafovitch et al.
2015/0362178 A1 12/2015 Karkow et al.
2015/0369476 A1 12/2015 Wiklof
2015/0369477 A1 12/2015 Karkow et al.
2016/0003471 A1 1/2016 Karkow et al.
2016/0018103 A1 1/2016 Karkow et al.
2016/0025333 A1 1/2016 Karkow et al.
2016/0025374 A1 1/2016 Karkow et al.
2016/0025380 A1 1/2016 Karkow et al.
2016/0033125 A1 2/2016 Krichtafovitch et al.
2016/0040872 A1 2/2016 Colannino et al.
2016/0046524 A1 2/2016 Colannino et al.
2016/0047542 A1 2/2016 Wiklof et al.
2016/0091200 A1 3/2016 Colannino et al.
2016/0109118 A1 4/2016 Krichtafovitch et al.
2016/0123576 A1 5/2016 Colannino et al.
2016/0123577 A1 5/2016 Dumas et al.
2016/0138799 A1 5/2016 Colannino et al.
2016/0138800 A1 5/2016 Anderson et al.
2016/0161110 A1 6/2016 Krichtafovitch et al.
2016/0161115 A1 6/2016 Krichtafovitch et al.
2016/0175851 A1 6/2016 Colannino et al.
2016/0215974 A1 7/2016 Wiklof

FOREIGN PATENT DOCUMENTS

WO WO 2015/017084 2/2015
WO WO 2015/042566 3/2015
WO WO 2015/042614 3/2015
WO WO 2015/042615 3/2015
WO WO 2015/051136 4/2015
WO WO 2015/054323 4/2015
WO WO 2015/057740 4/2015
WO WO 2015/061760 4/2015
WO WO 2015/070188 5/2015
WO WO 2015/089306 6/2015
WO WO 2015/103436 7/2015
WO WO 2015/112950 7/2015
WO WO 2015/123149 8/2015
WO WO 2015/123381 8/2015
WO WO 2015/123670 8/2015
WO WO 2015/123683 8/2015
WO WO 2015/123694 8/2015
WO WO 2015/123696 8/2015
WO WO 2015/123701 8/2015
WO WO 2016/003883 1/2016
WO WO 2016/007564 1/2016
WO WO 2016/018610 2/2016
WO WO 2016/105489 6/2016

* cited by examiner

TUNNEL BURNER INCLUDING A PERFORATED FLAME HOLDER

CROSS-REFERENCE TO RELATED APPLICATIONS

The present application claims priority benefit from U.S. Provisional Patent Application No. 62/117,403, entitled "TUNNEL BURNER INCLUDING A PERFORATED FLAME HOLDER," filed Feb. 17, 2015; which, to the extent not inconsistent with the description herein, is incorporated by reference.

SUMMARY

According to an embodiment, a tunnel burner includes a plurality of perforated flame holders configured to receive fuel and oxidant streams from a respective plurality of fuel and oxidant sources, the plurality of perforated flame holders being configured to hold a respective plurality of combustion reactions and collectively output heat into a tunnel oven. A conveyor belt carries items through the tunnel oven to receive heat from the plurality of perforated flame holders.

According to an embodiment, a heater includes a tunnel structure having an input end and an output end. A conveyor is configured to carry a product through the tunnel structure from the input end to the output end. A perforated flame holder is positioned inside the tunnel structure and configured to apply, to the product, thermal energy released by a combustion reaction held by the perforated flame holder.

According to an embodiment, a device includes a housing structure having first and second openings, a conveyor system configured to carry a product through the housing structure between the first and second openings, and a flame holder positioned within the housing. The flame holder has a first face, a second face lying opposite the first face, and a plurality of apertures extending through the flame holder between the first and second faces, the perforated flame holder being configured to hold a combustion reaction substantially within the plurality of apertures.

According to an embodiment, a method includes placing a product piece on a transport surface of a conveyor system and carrying the product piece into an oven housing by operation of the conveyor system. A combustion reaction is held within a plurality of apertures extending through a perforated flame holder. Thermal energy produced by the combustion reaction is applied to the product piece as it is carried through the housing by the conveyor system. Following the applying thermal energy, the product piece is carried out of the oven housing by further operation of the conveyor system.

DETAILED DESCRIPTION

Figure 1A:
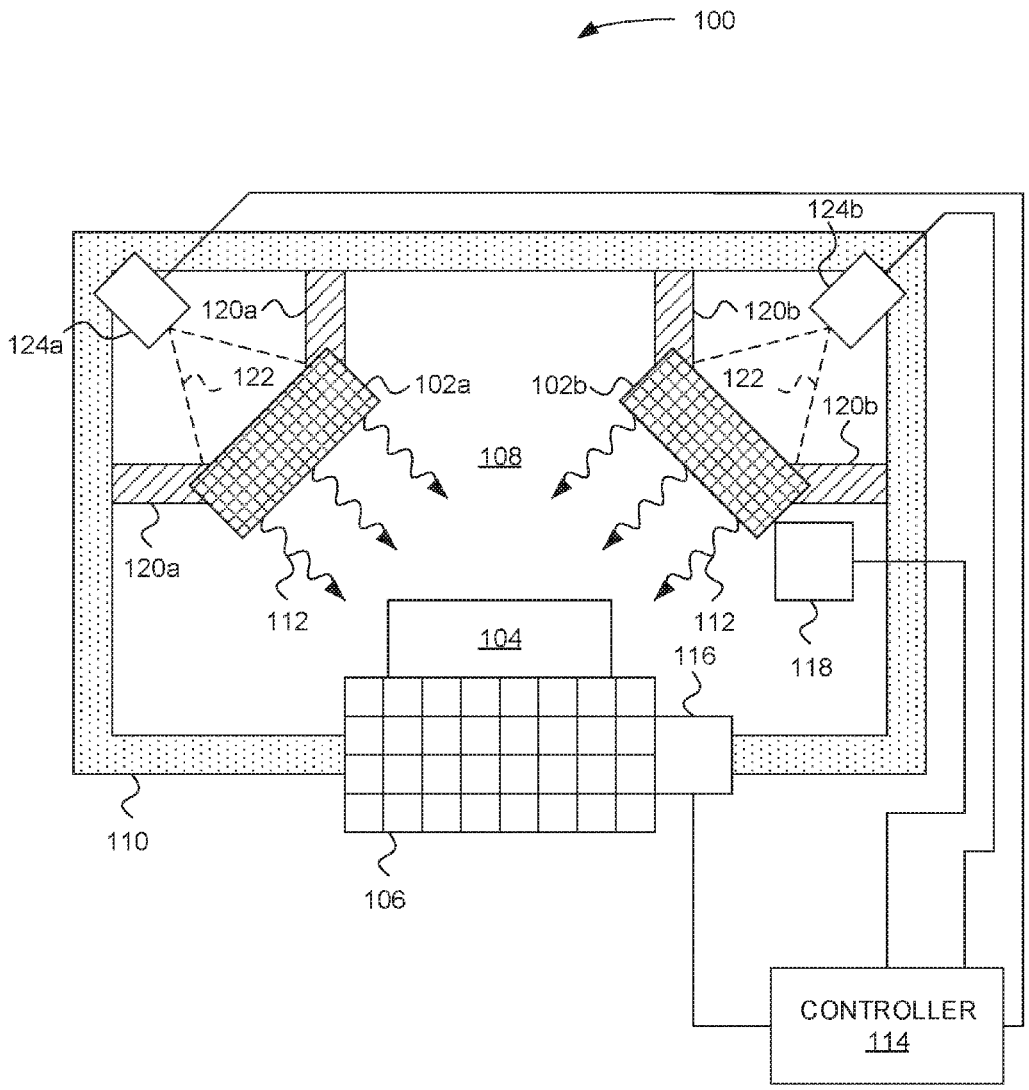
FIG. 1A is an end view diagram of a tunnel burner system including perforated flame holders, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Figure 1B:
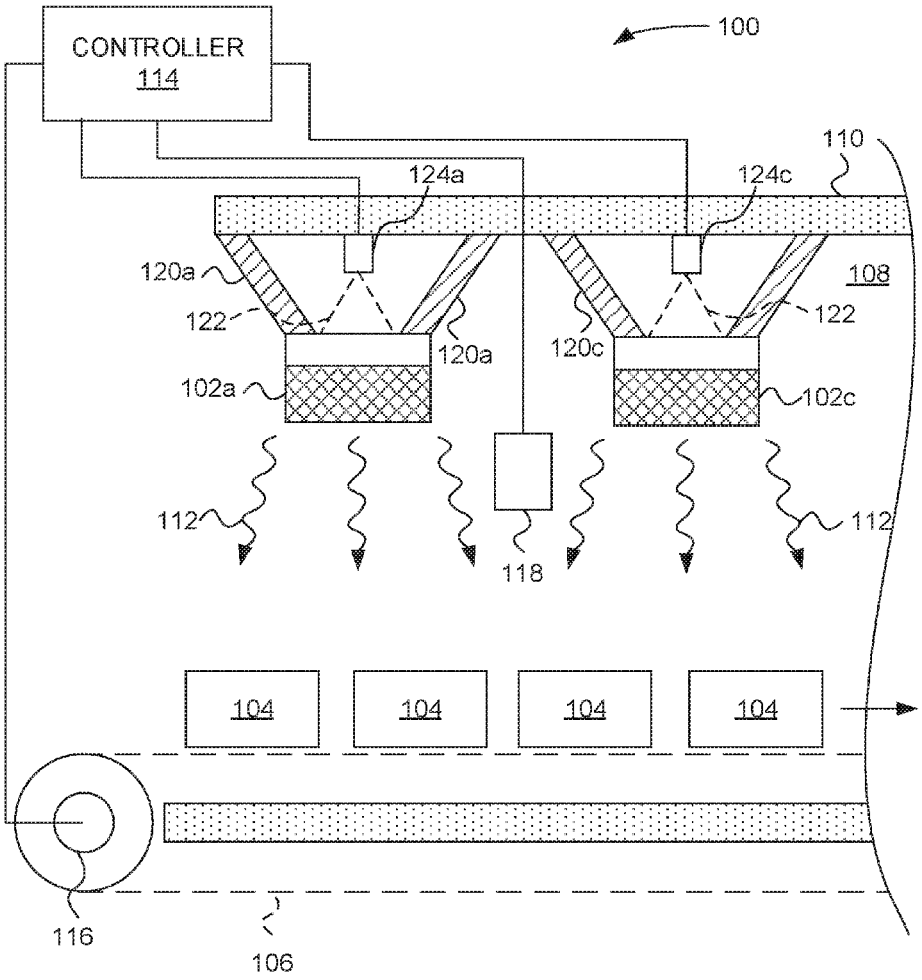
FIG. 1B is a side view diagram of the tunnel burner system of FIG. 1A, according to an embodiment.

FIG. 1A is an end view diagram of a tunnel burner system 100 including perforated flame holders 102*a*, 102*b*, according to an embodiment. FIG. 1B is a side view diagram of the tunnel burner system 100 of FIG. 1A, according to an embodiment. Referring to FIGS. 1A and 1B, the tunnel burner system 100 is configured to heat a series of items 104 carried by a conveyor belt 106 through a tunnel oven 108 defined by oven walls 110. A plurality of perforated flame holders 102*a*, 102*b*, 102*c*, etc. (referred to generically as 102) are supported by respective support structures 120*a*, 120*b*, 120*c* (referred to generically as 120) inside the oven 108 and supplied with fuel and oxidant mixtures 122 by respective fuel and oxidant sources 124*a*, 124*b*, 124*c* (referred to generically as 124) to support respective combustion reactions. The perforated flame holders 102 output thermal radiation 112 and convective thermal energy to the tunnel oven 108, and particularly to the series of items 104 as they are carried past the perforated flame holders 102 by the conveyor belt 106.

A controller 114 can be operatively coupled to the fuel and oxidant sources 124 to control a rate of the fuel and oxidant mixture 122 delivered to, and thereby an amount of heat or thermal energy output by, the respective perforated flame holders 102. The controller 114 can be operatively coupled to a motion encoder or motor 116 operatively coupled to the conveyor belt 106 to control or measure the motion of the belt. According to an embodiment, the controller 114 can control the output of heat from the perforated flame holders 102 to be proportional to the conveyor belt 106 speed to maintain the amount of heat delivered to each of the series of items 104.

According to an embodiment, one or more sensors 118 can sense conditions inside the tunnel oven 108. The controller 114 can be operatively coupled to the one or more sensors 118 to receive information about the sensed conditions. For example, the one or more sensors 118 can include a temperature sensor. The controller 114 can be programmed to modify a rate of fuel and oxidant mixture 122 delivered to each perforated flame holder 102, and thereby control the rate of heat output to maintain a desired temperature or temperature profile within the tunnel oven 108.

The inventors contemplate using the tunnel burner system 100 for a wide variety of applications. In an embodiment, the items 104 may include food items, wherein the perforated flame holders 102 provide heat for baking or broiling. In another embodiment, the items 104 may include items such as glass sheets that are annealed by the heat provided by the tunnel burner system 102. In another embodiment, the items 104 may include vitreous items such as tiles or pottery pieces that are fired by the tunnel burner system 102 or glazed vitreous items with glaze that is fused by heat provided by the tunnel burner system 102. In another example, the items 104 may include metal items that are heat treated by heat provided by the tunnel burner system.

According to an alternative embodiment, the conveyor belt 106 may be omitted and replaced by a rack or furnace floor onto which items 104 may be placed. According to an embodiment, the tunnel burner system 100 may be used to heat a continuously moving process item 104, such as a granulated, liquid, or other item that requires heating.

The perforated flame holders 102 can collectively support very clean combustion with low output of oxides of nitrogen (commonly referred to as NOx here) and carbon monoxide (CO).

Figure 2:
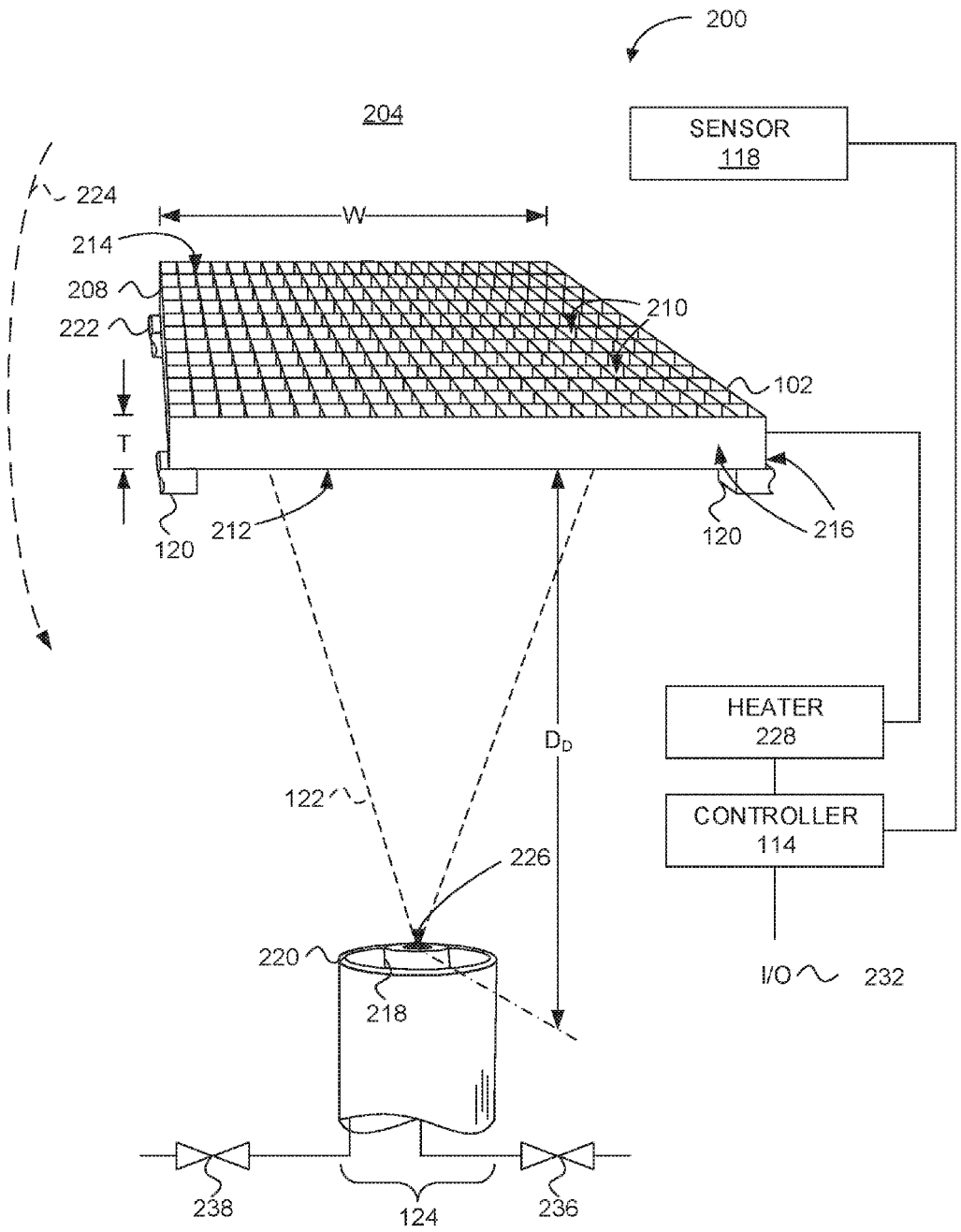
FIG. 2 is a simplified perspective view of a burner system including a perforated flame holder, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 124 disposed to output fuel and oxidant into a combustion volume 204 to form a fuel and oxidant mixture 122. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 122.

Figure 3:
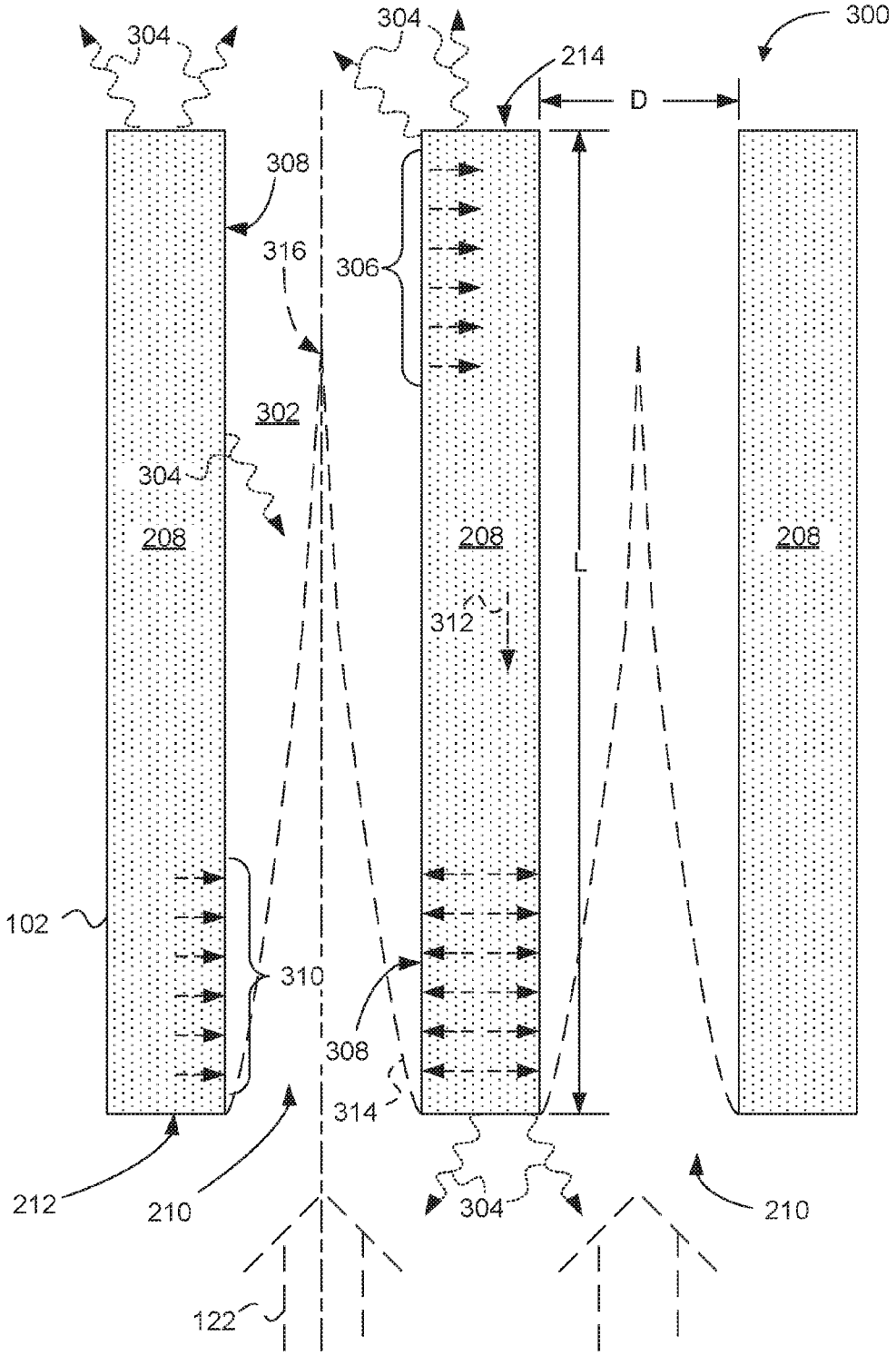
FIG. 3 is a side-sectional diagram of a portion of the perforated flame holder of FIGS. 1A, 1B and 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 122 from the fuel and oxidant source 124. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 122.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 122, an output face 214 facing away from the fuel and oxidant source 124, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 122 at the input face 212. The fuel and oxidant mixture 122 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 124 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 122 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 122 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 122. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 122 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 124 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 120 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 122 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 120 can support the perforated flame holder 102 to receive the fuel and oxidant mixture 122 at the distance $D_D$ away from the fuel nozzle 218 greater than 20 times the nozzle diameter. In another embodiment, the perforated flame holder 102 is disposed to receive the fuel and oxidant mixture 122 at the distance $D_D$ away from the fuel nozzle 218 between 100 times and 1100 times the nozzle diameter. Preferably, the perforated flame holder support structure 120 is configured to hold the perforated flame holder 102 at a distance about 200 times or more of the nozzle diameter away from the fuel nozzle 218. When the fuel and oxidant mixture 122 travels about 200 times the nozzle diameter or more, the mixture is sufficiently homogenized to cause the combustion reaction 302 to produce minimal NOx.

The fuel and oxidant source 124 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 124.

The support structure 120 can be configured to support the perforated flame holder 102 from a floor or wall (not shown) of the combustion volume 204, for example. In another embodiment, the support structure 120 supports the perforated flame holder 102 from the fuel and oxidant source 124. Alternatively, the support structure 120 can suspend the perforated flame holder 102 from an overhead structure (such as a flue, in the case of an up-fired system). The support structure 120 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 120 can be configured to support the plurality of perforated flame holder sections. The perforated flame holder support structure 120 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 308 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 122 contacts the input face 212 of the perforated flame holder 102, an average fuel-to-oxidant ratio of the fuel stream 122 is below a (conventional) lower combustion limit of the fuel component of the fuel stream 122—lower combustion limit defines the lowest concentration of fuel at which a fuel and oxidant mixture 122 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
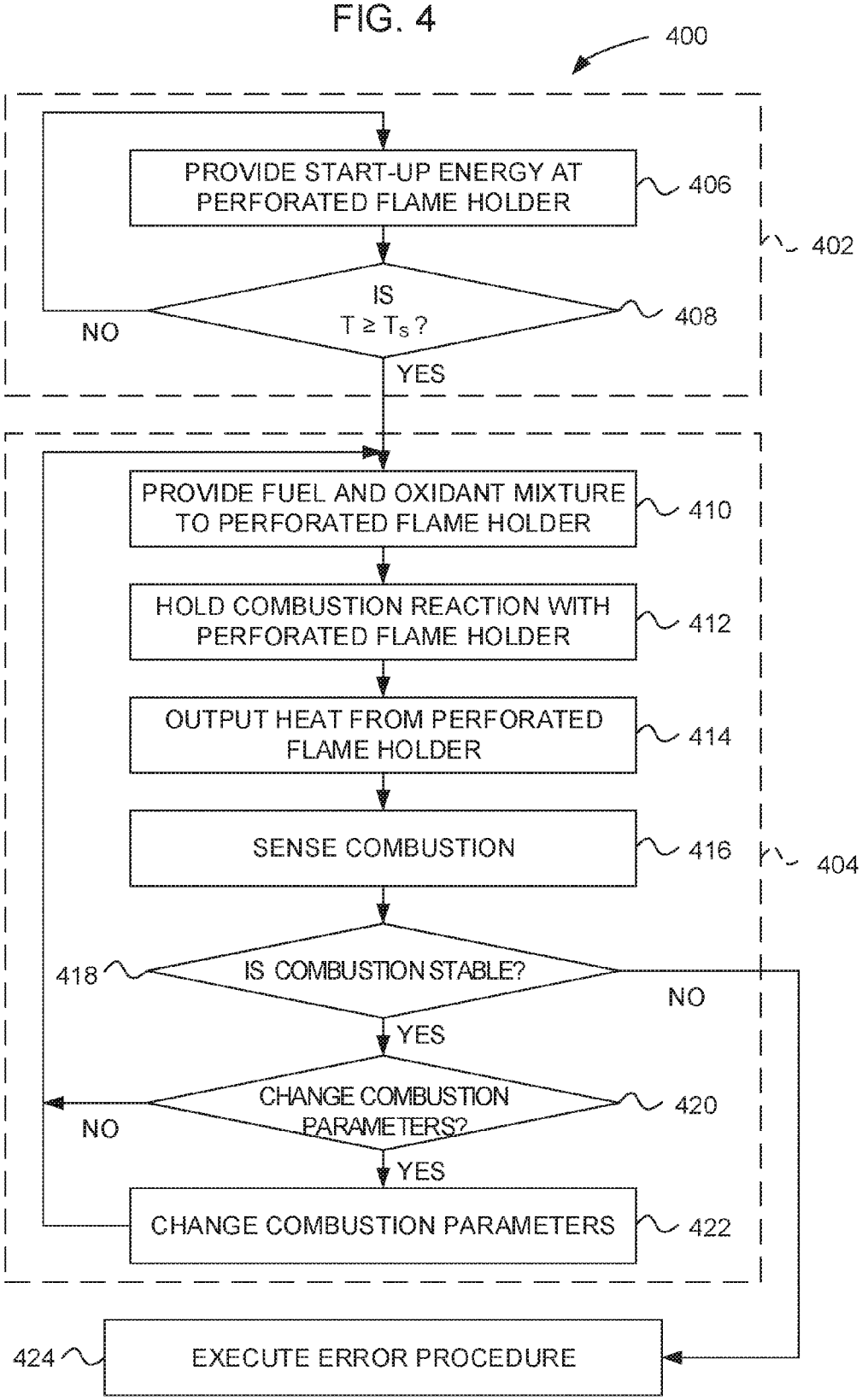
FIG. 4 is a flow chart showing a method for operating a burner system including the perforated flame holder of FIGS. 1A, 1B, 2 and 3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 122. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 124 can include a fuel nozzle 218 configured to emit a fuel stream 122 and an oxidant source 220 configured to output oxidant (e.g., combustion air) adjacent to the fuel stream 122. The fuel nozzle 218 and oxidant source 220 can be configured to output the fuel stream 122 to be progressively diluted by the oxidant (e.g., combustion air). The perforated flame holder 102 can be disposed to receive a diluted fuel and oxidant mixture 122 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 122 to cause heat-recycling and/or stabilizing vortices and thereby hold a start-up flame; or to be actuated to not intercept the fuel and oxidant mixture 122 to cause the fuel and oxidant mixture 122 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 122. An electrically conductive start-up flame holder may be selectively coupled to a voltage ground or other voltage selected to attract the electrical charge in the fuel and oxidant mixture 122. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 122. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 122 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 122 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 124. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 124. The controller 230 can be configured to control the fuel control valve 236 responsive to input from the combustion sensor 234. The controller 230 can be configured to control the fuel control valve 236 and/or oxidant blower or damper to control a preheat flame type of heater 228 to heat the perforated flame holder 102 to an operating temperature. The controller 230 can similarly control the fuel control valve 236 and/or the oxidant blower or damper to change the fuel and oxidant mixture 122 flow responsive to a heat demand change received as data via the data interface 232.

Figure 5:
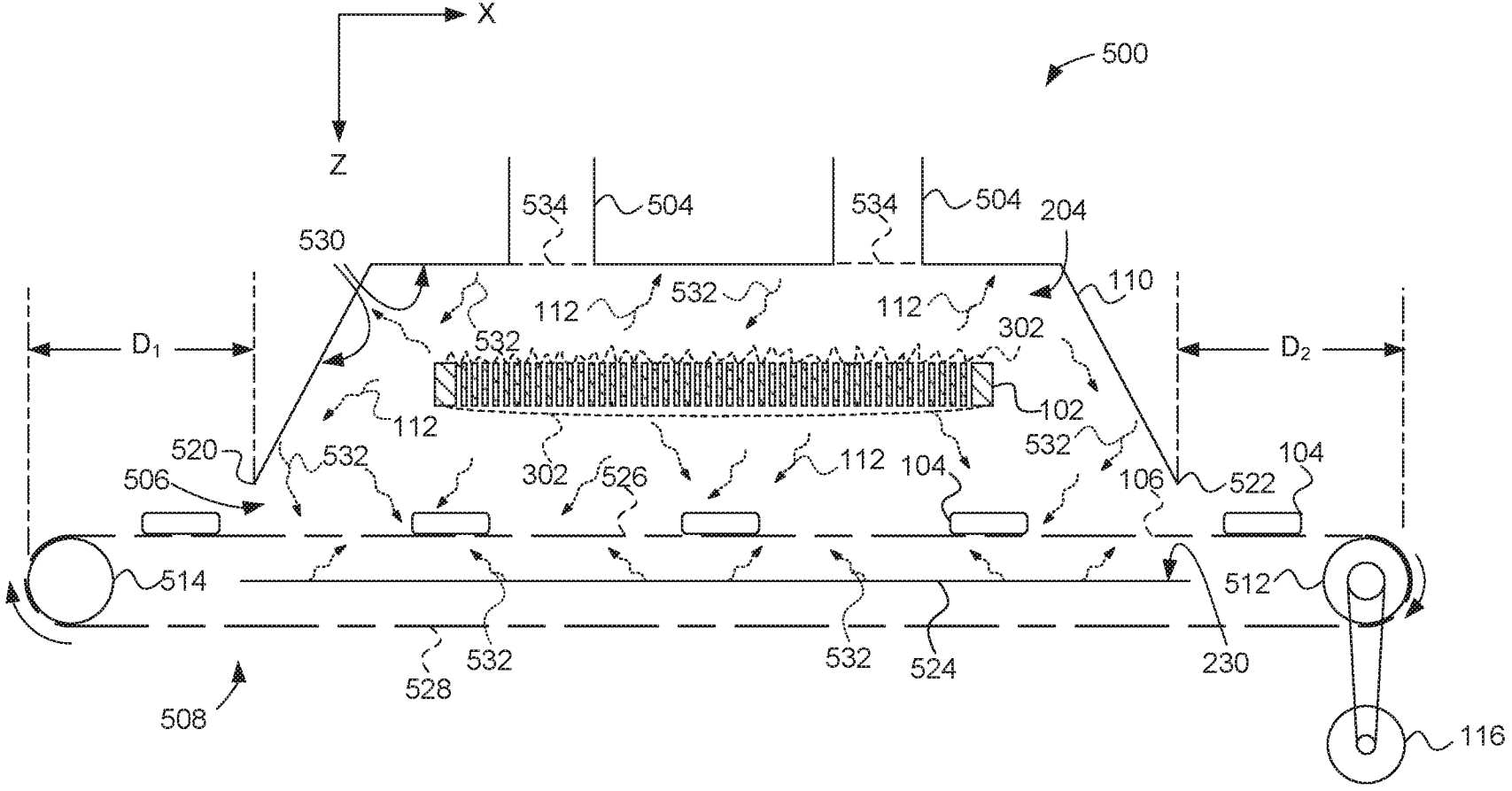
FIG. 5 is a diagrammatical side representation, as viewed in an X-Z plane, of a combustion system that includes a burner similar to the burner described with reference to FIGS. 1, 2, and 3, according to an embodiment.

FIG. 5 is a diagrammatical side representation, as viewed in an X-Z plane, of a combustion system 500 that includes a burner similar to the burner described with reference to FIGS. 2-3, according to an embodiment. The combustion system 500 can include a perforated flame holder 102 configured to support a combustion reaction 302. A combustion volume 204 can be defined by a housing 110. Cooled flue gas may be vented to the atmosphere through one or more exhaust flues 504. The view of FIG. 5 is selected to enable a clear description of the system, rather than to show a true physical representation of the pictured device. For example, many elements that are not essential to understanding of the system are omitted, such as the support structure (shown in FIGS. 1A, 1B, and 2 with a reference number 120) configured to hold the perforated flame holder 102 in position, the system for delivering fuel to the flame holder 102, and the structure configured to support the combustion system 500. Additionally, the perforated flame holder 102 is shown in cross-section, while portions of the housing 110 are not shown, to enable a view of the interior. Although the embodiment of the combustion system 500 is shown in FIG. 5 as having a single perforated flame holder 102, other embodiments are contemplated, that include a plurality of perforated flame holders 102. In some cases, the size of the combustion system 500 may make it impractical or impossible to employ a single perforated flame holder 102 of a sufficient size. In other cases, it may be desirable for economic reasons, or for ease of service, to employ smaller individual perforated flame holders 102 arranged in a linear array, i.e., lying in a common horizontal plane.

The combustion system 500 can include a conveyor system 508 configured to transport items 104 into, through, and out of the housing 110, where the product may be exposed to heat produced by the combustion reaction 302. In the embodiment shown, the conveyor system 508 includes a conveyor belt 106 extending between a drive roller 512 and a follower roller 514. The conveyor system 508 may be powered by a variable speed motor 116 coupled to the drive roller 512. Other conveyor system configurations are also envisioned in which, for example, movable carts can be manually or automatically pushed or pulled through the tunnel oven. Such carts may include wheels running on rails or other means for aligning carts, similar to those used in tunnel kilns.

A tunnel 506 extending through the housing 110 can be defined by a first opening 520 of the housing 110, a second opening 522 of the housing 110, and a path followed by the conveyor system 508 between the first opening 520 and the second opening 522. One of the first and second openings 520, 522 can act as an entrance to the tunnel 506 while the other of the first and second openings 520, 522 can act as an exit from the tunnel 506, depending upon the direction of travel of the conveyor belt 106. In embodiments in which the motor 116 is reversible, either of the first and second openings 520, 522 can act as the entrance or exit. For simplicity and clarity, it will be assumed, for the purposes of this description, that the product is carried by the conveyor system 508 from left to right, as viewed in FIG. 5, with the first opening 520 acting as the entrance to the tunnel 506 and the second opening 522 acting as exit.

Combustion systems of the type described here can be referred to as ovens, furnaces, or kilns, but may also be referred to by other terms, depending, for example, upon the intended purpose of a specific application, and the type of product intended to be processed. The item 104 is shown as generic shapes in the drawings herein. According to various embodiments, the product can be, for example, a food product or a product of manufacture, as will be further discussed in more detail.

In the embodiment of FIG. 5, a bottom portion 524 of the housing 110 extends between an upper webbing 526 of the conveyor belt 106, on which the items 104 are carried through the tunnel 506, and a lower webbing 528 of the conveyor belt 106. According to another embodiment, the housing 110 encloses both webbings of the conveyor belt 510.

According to an embodiment, the conveyor belt 510 extends a first distance $D_1$ from the first opening 520, and a second distance $D_2$ from the second opening 522. Assuming that the first and second openings 520, 522 act respectively as the entrance and exit to the tunnel 506, the first distance $D_1$ can be selected, in part, on the basis of maximum dimensions of the item 104 that is intended to be processed by the combustion system 500. For example, it can be preferable that the portion of the conveyor belt 510 that extends from the first opening 520 is laterally larger than the item 104, thus permitting an operator to simply place the item 104 on the conveyor belt 510, rather than supporting a portion of the item 104 as it is carried into the first opening 520.

The second distance $D_2$ can be selected, in part, according to a desired cool-down period of the item 104. The conveyor system 508 can be configured such that as the item 104 is carried to the end of the conveyor belt 510, it may be permitted to drop into a bin or onto a stacking table, etc. Depending on the nature of the item 104, if individual pieces of the product are not sufficiently cooled prior to reaching the end of the belt 510, they may stick together when stacked, or they may not cool immediately, so that they continue to cook, or otherwise react to heat, beyond what is intended. By extending the distance $D_2$, the cool-down period of the item 104 can be made longer. This may also enable a higher belt speed, which may be beneficial to productivity.

In operation, pieces of the item 104 may be placed on the conveyor belt 510 and carried into the housing 110 through the first opening 520. As the item 104 passes through the tunnel 506, it may be exposed to heat from the combustion reaction 302 held by the perforated flame holder 102, after which may be carried out of the housing 110 through the second opening 522. The amount of thermal energy received and absorbed by the product is, in part, a function of the amount of thermal energy produced by the combustion system 500, and of the amount of time during which the item 104 is exposed to heat. This, in turn, may depend on the length of the tunnel 506 and the speed of the conveyor belt 510. From a practical standpoint, the heat production of the combustion system 500 can be modified to make gross adjustments to the applied energy, while fine adjustments may be more easily made by changes in the belt speed.

Most of the heat produced by the combustion reaction 302 may be released by the perforated flame holder 102 via thermal radiation 112. According to an embodiment, interior surfaces 530 of the housing 110 are configured to be substantially reflective to thermal radiation 112, so that much of the heat that radiates upward from the perforated flame holder 102 is reflected back to the perforated flame holder 102 or toward the conveyor belt 510 as reflected thermal radiation 532. Similarly, radiant heat (herein, also referred to as thermal radiation) 112 that passes downward through the upper webbing 526 of the conveyor belt 106 may be reflected by the bottom portion 524 of the housing 110 to impinge on lower surfaces of the item 104. In the embodiment shown, the exhaust flues 504 are provided with thermally-reflective screens 534 to reduce the loss of radiated heat via the exhaust flues 504.

According to an embodiment, the conveyor belt 510 is configured to absorb as little of the thermal radiation as possible, to improve efficiency of the combustion system 500 and to facilitate cooling of the item 104 after it exits the tunnel 506. The conveyor belt 510 can be configured to be substantially transparent to thermal radiation 112, which may permit more thermal energy to pass through the belt and reflect from the bottom panel 524 of the housing 110 to impinge on the lower surface of the item 104. Alternatively, the conveyor belt 510 can be substantially reflective to thermal energy, which may minimize the amount of heat reaching the lower surface of the item 104.

FIGS. 6-12 are diagrammatic end views, shown in a Y-Z plane, of combustion systems according to respective embodiments, each sharing many characteristics with the combustion system 500 of FIG. 5, but also having respective unique characteristics, as shown and described below. As with the side view shown in FIG. 5, the views of FIGS. 6-12 are selected to enable a clear understanding of the respective systems, with many non-essential elements being omitted. In general, the detailed descriptions will focus primarily on those portions of each embodiment that are substantially different from other disclosed embodiments. It will be recognized that elements of various disclosed embodiments can be combined to form further embodiments.

Figure 6:
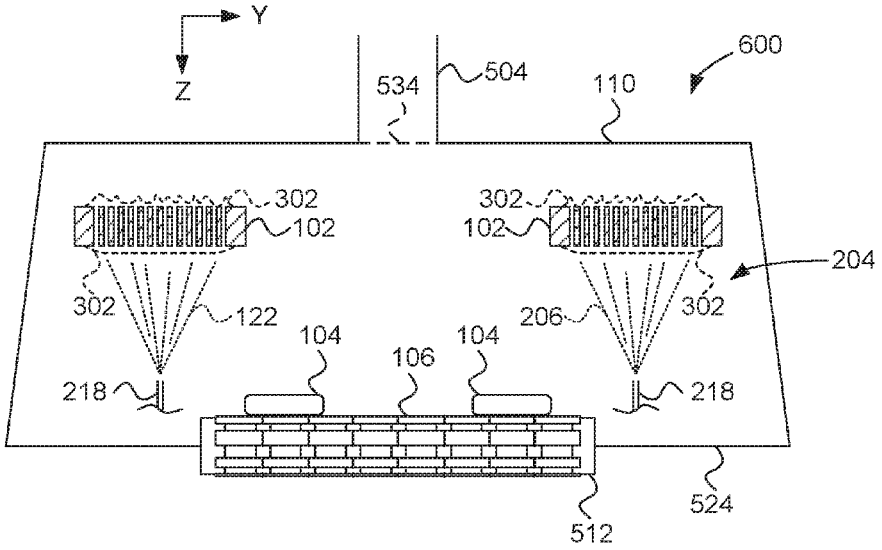
FIGS. 6-12 are diagrammatic end views, shown in a Y-Z plane, of combustion systems according to respective embodiments, each sharing many characteristics with the combustion system of FIG. 5, but also having respective unique characteristics, as shown and described.

FIG. 6 shows a combustion system 600, according to an embodiment, that includes first and second perforated flame holders 102 arranged horizontally in a common X-Y plane lying parallel to an upper surface of a conveyor belt 106. According to an embodiment, each of the first and second flame holders 102 of FIG. 6 extends, in the X-axis, substantially the length of the tunnel 506 (shown in FIG. 5), as shown in FIG. 5. According to another embodiment, each of the first and second flame holders 102 shown in FIG. 6 represents a respective row of perforated flame holders 102 extending in the X-axis. The perforated flame holders 102 can be positioned on either side or both sides of the conveyor belt 106.

Figure 7:
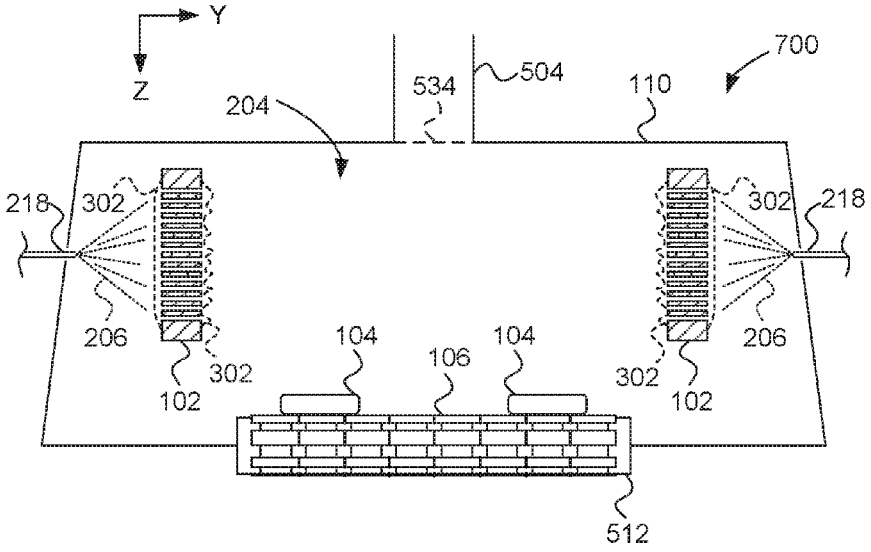

FIG. 7 shows a combustion system 700, according to an embodiment, that includes first and second perforated flame holders 102 arranged vertically in parallel X-Z planes perpendicular to an upper surface of the conveyor belt 106. Nozzles 218 can have respective longitudinal axes extending parallel to the Y axis, and can be configured to emit respective fuel streams 122 from the sides toward the respective perforated flame holders 102. According to an embodiment, each of the first and second perforated flame holders 102 of FIG. 7 extends, in the X-axis, substantially the length of the tunnel 506 (shown in FIG. 5). According to another embodiment, each of the first and second perforated flame holders 102 shown in FIG. 7 represents a respective row of perforated flame holders 102 extending in the X-axis. The perforated flame holders 102 can be positioned facing each other on either side of the conveyor belt 106.

According to an embodiment, the combustion system 700 is configured to provide an increased amount of thermal radiation impinging on the item 104 from the interior surfaces 530 (shown in FIG. 5) of the housing 110, which may be advantageous in systems designed to heat a product that has significant height or thickness, or is characterized by high density.

As previously noted, the item 104 can be any of many different types of products. In some embodiments, it may be desirable to apply thermal energy to the product primarily via thermal radiation. In other embodiments, it may be desirable to apply a substantial part of thermal energy to the product via convection. One pertinent distinction between these heat transfer mechanisms is that heat transmitted via thermal radiation may tend to impinge on the product primarily on surfaces that face the heat source, while a convection-type system can circulate heated air around the product, which may serve to apply heat evenly to all sides of the product, according to one interpretation.

In an embodiment of a combustion system intended, for example, for operation as a curing oven in a printing process, it may be preferable to limit heat transmission, to the extent possible, to heat radiation. For example, in many textile printing processes, a thin film of polymeric ink is applied to a fabric substrate in a screen-printing operation. The ink is cured by raising its temperature to at least a cure threshold, which may be around 320° F., for example. When the ink reaches the cure temperature, it polymerizes, instantly solidifying. This process can be used in t-shirt printing systems. One hazard in such systems is that the temperature at which the fabric will scorch is not much higher than the cure temperature of the ink, so it is desirable to exercise careful control of the heat applied, and to limit the heat applied to the fabric. A curing oven that employs a radiant heat source positioned above the conveyor system and in a plane parallel to the upper surface of the conveyor belt may be ideal for such applications. The radiant heat impinges on the top surface of the printed fabric. The ink can be formulated to readily receive the thermal energy, which is quickly transmitted through the thin ink film. Meanwhile, the fabric is thicker, and heats slower, so it may lag in temperature rise. Additionally, many fabrics and fabric colors are at least partially reflective to thermal radiation. Thus, thermal radiation may be most effective at curing plastic-based inks without damaging the fabric substrates. Radiant heat can be similarly beneficial in other printing processes, such as for banners, posters, etc. Where three-dimensional printing processes are employed, such as pad printing of ad products, bottles, and other manufactured products, it may be preferable to use a system that is capable of providing radiant heat from several directions, like the combustion system 700 described with reference to FIG. 7.

Thus, for example, in combustion systems like those described above with reference to FIGS. 5 and 6, upper surfaces of the item 104 may receive the majority of the thermal energy. This may be acceptable in applications where the product is sufficiently thin, or not very dense for heat to quickly penetrate through the product. However, this may be less advantageous in applications where the product has a greater thickness or density, so that the heating of the product is less even, with the bottom of the product receiving less thermal energy than the top. To an extent, the configuration of the combustion system shown in FIG. 7 may provide adequate distribution of thermal energy for processing rather thick of dense items.

In processing a food product, configuration of the combustion system may depend on the types of processes, as well as the kind of the food product. For example, according to an embodiment, the combustion system is configured as a food dryer. Such an embodiment may require a relatively low temperature provided over an extended time period. According to another embodiment, the combustion system is configured as an oven for baking a food product. In some applications, a radiant-heat system may be adequate, particularly in embodiments where the product is formed or sliced thinly, so that heat impinging on one surface can quickly penetrate through the thickness of the product. On the other hand, if the product is not sufficiently thin, the heat may be applied unevenly, so that the product is not properly processed. In such cases, a convection-type system, or a system that combines radiant and convection heat may be preferable. One example of a convection-type system is described below with reference to FIG. 8.

Figure 8:
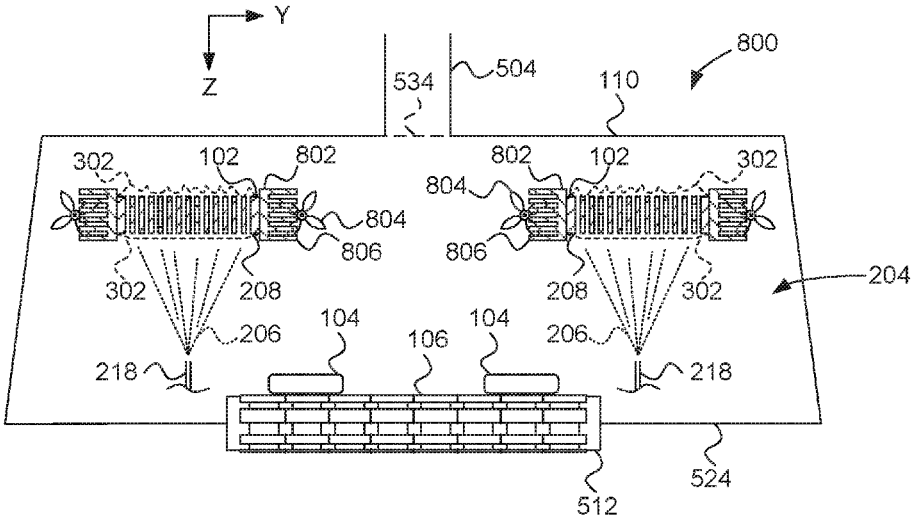

FIG. 8 shows a combustion system 800, according to an embodiment, that includes first and second perforated flame holders 102 arranged horizontally in a common X-Y plane lying parallel to an upper surface of a conveyor belt 106. Additionally, heat sinks 802 can be coupled to the body 208 of the perforated flame holders 102 and configured to draw heat from the perforated flame holders 102, reducing the amount of heat emitted via radiation. Fans 804 circulate air through cooling fins 806 of the heat sinks 802, circulating the heat throughout the combustion volume 204 by convection. In embodiments where the circulation of air by the fans 804 may disrupt operation of the combustion reaction 302 in the perforated flame holders 102, the fans 804 and cooling fins 806 can be ducted, so that movement of convection air is isolated from the perforated flame holders 102.

In embodiments that include elements configured to provide convection heating, the proportion of heat transmitted via radiation, relative to convection, can be controlled by, for example, selection of the size of the heat sinks 802, the position and/or distance of the perforated flame holders 102, relative to the conveyor belt 106, and the volume of air circulated through the cooling fins 806. In an embodiment, the combustion system 800 can include the perforated flame holder 102 physically isolated from the conveyor system 508, resulting in the majority of thermal energy being delivered to an item 104 via convection, using air ducted to the item 104 from the perforated flame holder 102.

Figure 9:
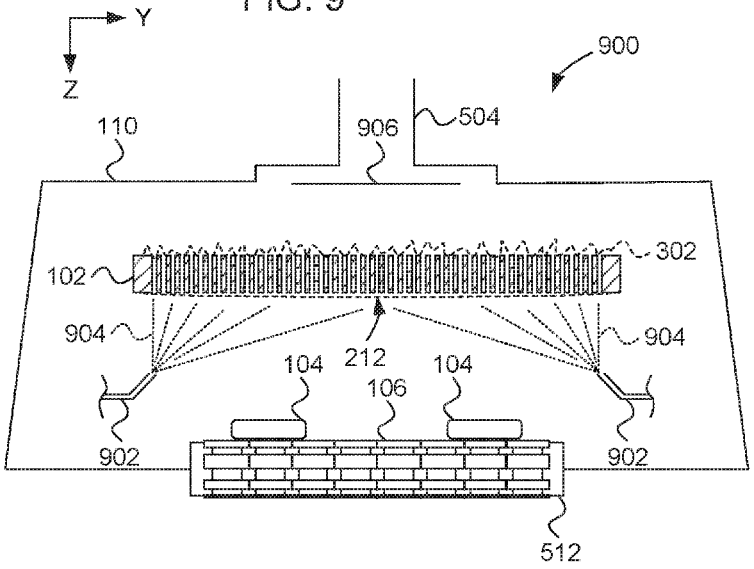

FIG. 9 shows a combustion system 900, according to an embodiment, that includes a single perforated flame holder 102 extending, along the Y-axis, over the width of a conveyor belt 106. Nozzles 902 can be positioned at the sides of the perforated flame holder 102 at oblique angles, and are configured to emit respective fuel streams 904 toward a first face 212 of the perforated flame holder 102. Each of the nozzles 902 can be configured to emit a fuel stream 904 in an asymmetrical pattern, with a larger volume of fuel being emitted toward the center of the perforated flame holder 102, and at a higher velocity, than fuel being emitted toward the edges of the perforated flame holder 102. Because the fuel streams 904 expand as they flow outward, the portions that travel farther disperse more, so that the fuel flowing toward the center of the perforated flame holder 102, which travels farther before reaching the perforated flame holder 102, is more dispersed than the fuel flowing toward the edges. This effect can be compensated for by the difference in the volume of fuel emitted, so that the amount of fuel that reaches the perforated flame holder 102 may be substantially equalized over the surface of the first face of the perforated flame holder 102. As with other embodiments, the perforated flame holder 102 of the system 900 can be a single perforated flame holder 102 as depicted in the combustion system 500 of FIG. 5, or can include a plurality of perforated flame holders 102 arranged in a row extending parallel to the X-axis.

The embodiment of FIG. 9 can be advantageous in applications where an even distribution of thermal radiation over the width of the conveyor belt 106 is preferred.

In an embodiment, the system 900 of FIG. 9 can also include a baffle 906 positioned over the opening of the exhaust flue 504. Such an arrangement constitutes an example of another structure of the combustion system 900, configured to reduce the loss of radiant heat via the exhaust flue 504.

Figure 10:
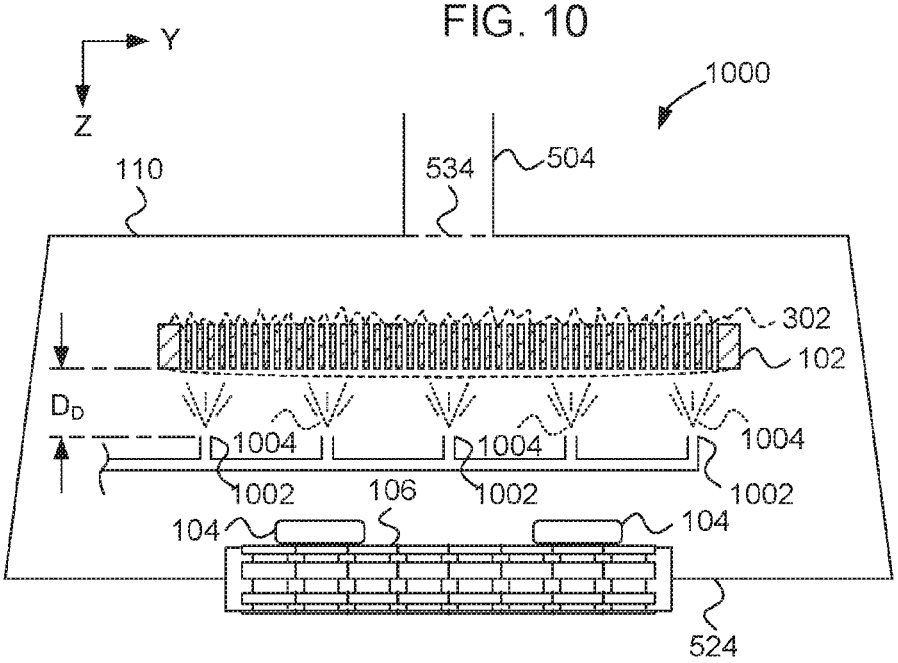

FIG. 10 shows a combustion system 1000, according to an embodiment, that is similar in most respects to the combustion system 900 of FIG. 9. However, the system 1000 can include a plurality of nozzles 1002, each configured to deliver a fuel stream 1004 to a respective portion of the perforated flame holder 102. In addition to advantages described with reference to the combustion system 900, the embodiment shown in FIG. 10 may be advantageous where the distance $D_D$ between the perforated flame holder 102 and the item 104 on the conveyor belt 106 is relatively short. By employing a plurality of nozzles 1002, each providing fuel to a relatively smaller portion of the perforated flame holder 102, the nozzles 1002 can be positioned closer to the perforated flame holder 102, permitting a further reduction in the distance between the perforated flame holder 102 and the conveyor belt 106.

With a reduced distance $D_D$, the fuel streams 1004 may entrain less oxidant than, for example, the fuel stream 122 described with reference to FIG. 2. Accordingly, to ensure that the proper fuel-to-oxidant ratio is achieved, according to an embodiment, the fuel streams 1004 include a premixed oxidant that is emitted from the nozzles 1002 with the fuel. Additionally, even though the fuel streams 1004 include a premixed oxidant, the fuel-to-oxidant ratio of the portion of the fuel streams 1004 that are emitted from the nozzles 1002 can be selected to be above an upper combustion limit of the fuel, to avoid the possibility of flashback, as discussed above with reference to the system 200 of FIG. 2. Within this limit, the fuel and oxidant mixture, the distance $D_D$, and the flow rate and pressure of the fuel can be selected to produce fuel streams 1004 having a selected fuel-to-oxidant ratio as they reach the perforated flame holder 102.

Figure 11:
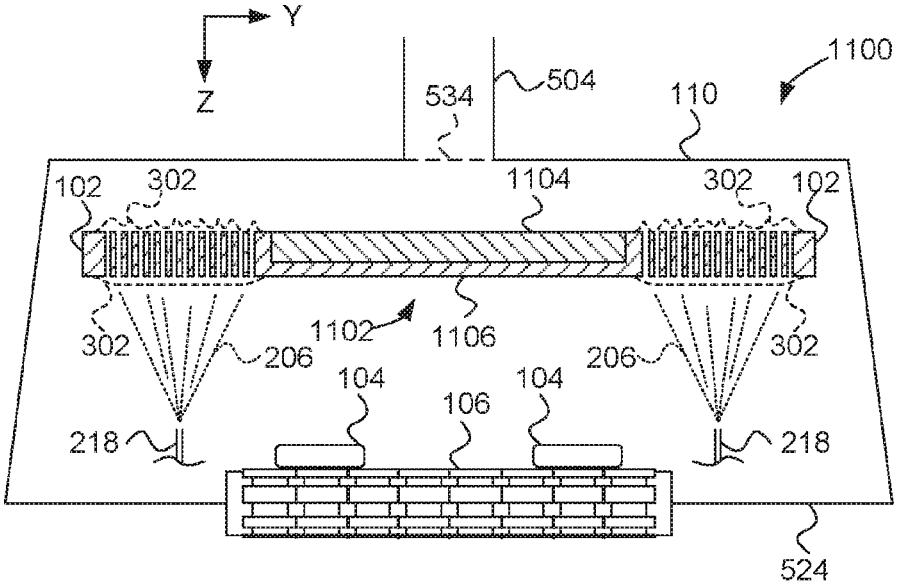

FIG. 11 shows a combustion system 1100, according to an embodiment, that includes first and second perforated flame holders 102 arranged horizontally in a common X-Y plane lying parallel to an upper surface of a conveyor belt 106, substantially as described, for example, with reference to the combustion system 600 shown in FIG. 6. Additionally, the combustion system 1100 can also include a thermally conductive bridge 1102 extending between the perforated flame holder 102 and above a conveyor belt 106. The bridge 1102 can be configured to draw thermal energy from the first and second perforated flame holders 102 and release the heat via radiation over the conveyor belt 106. According to an embodiment, the bridge 1102 includes an insert 1104 that can be made of a highly thermally conductive material, such as, for example, copper. The insert 1104 is received in a cavity formed in a radiating element 1106 made of a material selected for its radiation characteristics. According to one embodiment, the bridge 1102 is a separate element that is coupled to the perforated flame holder 102. According to another embodiment, the bridge 1102, or at least the radiating element 1106, is integral with the perforated the flame holders 102, all made from the same material.

The material of the perforated flame holders 102 can be selected according to a number of factors, including its capacity to tolerate the temperatures characteristic for the combustion reaction 302, as well as its radiation characteristics. In an embodiment, it may be preferable for the material of the perforated flame holders 102 to be capable of efficiently producing blackbody-type radiation. The thermal conductivity of the material may be not a major factor. In the bridge 1102 of the system 1100, the insert 1102 serves to absorb thermal energy from the perforated flame holder 102, and evenly distribute the heat across the bridge 1102. The heat is transmitted via conduction to the relatively thin radiating element 1106, which may further transmit the thermal energy via radiation.

The embodiment of FIG. 11 may provide advantages associated with the embodiments of FIGS. 6-8, such as simple fuel distribution and conventional nozzles, along with advantages of the embodiments of FIGS. 9 and 10, such as an even distribution of thermal radiation and an ability to position the heat source close to the conveyor belt 106.

Figure 12:
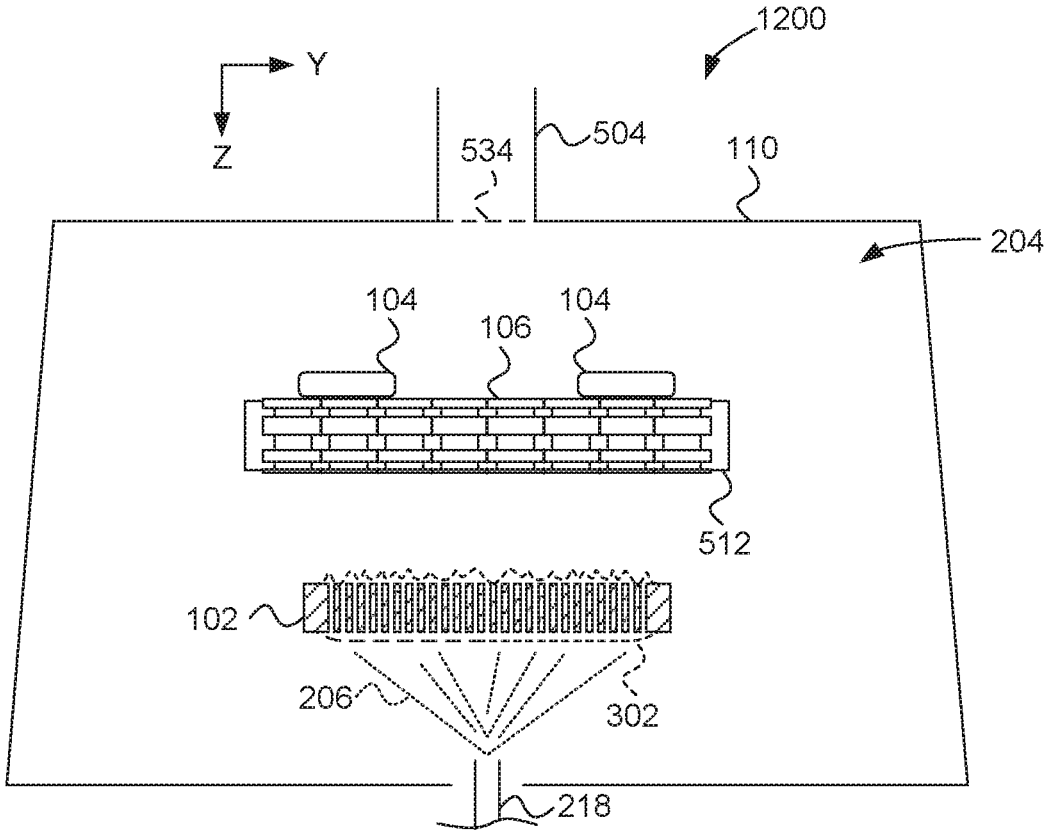

FIG. 12 shows a combustion system 1200, according to an embodiment, that includes a perforated flame holder 102 positioned below a conveyor belt 106. The system 1200 can include a single perforated flame holder 102 as shown in FIG. 12, or it can comprise a plurality of perforated flame holders 102, arranged in one or more rows extending parallel to either or both of the X and Y axes.

According to an embodiment, the material of the conveyor belt 106 is selected to be substantially transparent to thermal radiation, permitting an item 104 to receive thermal radiation through the belt. For example, the conveyor belt can be made from stainless steel wire and/or links, with relatively large spaces between the wires and/or links. Because of the wide spacing of the elements of the conveyor belt 106, the belt may be relatively transparent to thermal radiation, which may be permitted to pass through to an item 104. Because stainless steel has a relatively low thermal conductivity, the elements of the conveyor belt 106 can be largely reflective to thermal radiation, and resist being heated substantially.

According to another embodiment, the combustion system 1200 can be configured to operate as a convection-type system. In this embodiment, heat sinks and fans like those described with reference to FIG. 8 are provided, coupled to the perforated flame holder 102, to circulate heat within a housing 110. In an embodiment, the housing 110 can also include a baffle (not shown) positioned between the perforated flame holder 102 and the conveyor belt 106, configured to prevent thermal radiation from impinging on the item 104 or the conveyor belt 106, so that the item 104 is processed using predominantly convection heat.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A heater system, comprising:

a tunnel structure having an input end and an output end;

a conveyor system configured to carry a product through the tunnel structure from the input end to the output end; and a perforated flame holder positioned inside the tunnel structure and configured to apply, to the product, thermal energy released by a combustion reaction held by the perforated flame holder, the perforated flame holder including:

a first face, a second face parallel to the first face, and a plurality of apertures extending through the perforated flame holder from the first face to the second face;

wherein the perforated flame holder is one of a plurality of perforated flame holders positioned inside the tunnel structure and configured to collectively apply, to the product, thermal energy released by combustion reactions held by the respective ones of the plurality of perforated flame holders; and wherein a first one of the plurality of perforated flame holders is positioned with a corresponding first face lying in a first plane that is substantially perpendicular to a plane defined by a surface of the conveyor system, and a second one of the plurality of perforated flame holders is positioned with a corresponding first face lying in a second plane that is substantially perpendicular to the plane defined by the surface of the conveyor system and substantially parallel to the first plane.

2. The heater system of claim 1, wherein each one of the plurality of perforated flame holders is positioned with the first face lying in a common plane that is substantially parallel to a plane defined by a surface of the conveyor system.

3. The heater system of claim 2, wherein the plurality of perforated flame holders is arranged in a row extending parallel to a direction of movement of the product through the tunnel structure.

4. The heater system of claim 2, wherein the plurality of perforated flame holders is arranged in a row extending perpendicular to a direction of movement of the product through the tunnel structure.

5. The heater system of claim 1, wherein a third one of the plurality of perforated flame holders is positioned with a corresponding first face lying in the first plane, and a fourth one of the plurality of perforated flame holders is positioned with a corresponding first face lying in the second plane.

6. The heater system of claim 1, wherein the perforated flame holder is configured to apply thermal energy to the product by irradiating the product with thermal energy released by the combustion reaction.

7. The heater system of claim 1, comprising a convection system configured to apply thermal energy to the product by applying the thermal energy released by the combustion reaction to convection air, and by circulating the convection air around the product within the tunnel structure.

8. A heater system, comprising:

a tunnel structure having an input end and an output end;

a conveyor system configured to carry a product through the tunnel structure from the input end to the output end;

a perforated flame holder positioned inside the tunnel structure and configured to apply, to the product, thermal energy released by a combustion reaction held by the perforated flame holder, the perforated flame holder including:

a first face, a second face parallel to the first face, and a plurality of apertures extending through the perforated flame holder from the first face to the second face; and a convection system configured to apply thermal energy to the product by applying the thermal energy released by the combustion reaction to convection air, and by circulating the convection air around the product within the tunnel structure;

wherein the convection system comprises a heat sink thermally coupled to the perforated flame holder and configured to draw thermal energy from the perforated flame holder.

9. A heater system, comprising:

a tunnel structure having an input end and an output end;

a conveyor system configured to carry a product through the tunnel structure from the input end to the output end;

a perforated flame holder positioned inside the tunnel structure and configured to apply, to the product, thermal energy released by a combustion reaction held by the perforated flame holder, the perforated flame holder including:

a first face, a second face parallel to the first face, and a plurality of apertures extending through the perforated flame holder from the first face to the second face; and a fuel nozzle positioned at an oblique angle relative to the faces of the perforated flame holder, and configured to emit an asymmetrical fuel stream toward the face of the perforated flame holder.

10. A heater system, comprising:

a tunnel structure having an input end and an output end;

a conveyor system configured to carry a product through the tunnel structure from the input end to the output end;

a perforated flame holder positioned inside the tunnel structure and configured to apply, to the product, thermal energy released by a combustion reaction held by the perforated flame holder, the perforated flame holder including:

a first face, a second face parallel to the first face, and a plurality of apertures extending through the perforated flame holder from the first face to the second face; and a plurality of fuel nozzles positioned opposite the first face of the perforated flame holder, each being configured to emit a fuel stream toward a respective portion of the face of the perforated flame holder.

11. A heater system, comprising:

a tunnel structure having an input end and an output end;

a conveyor system configured to carry a product through the tunnel structure from the input end to the output end; and a perforated flame holder positioned inside the tunnel structure and configured to apply, to the product, thermal energy released by a combustion reaction held by the perforated flame holder, the perforated flame holder including:

a first face, a second face parallel to the first face, and a plurality of apertures extending through the perforated flame holder from the first face to the second face;

wherein the perforated flame holder is a first perforated flame holder, and further comprising a second perforated flame holder and a thermally conductive bridge, the thermally conductive bridge being thermally coupled, at a first end, to the first perforated flame holder, and, at a second end, to the second perforated flame holder, the thermally conductive bridge being configured to draw thermal energy from the first and second perforated flame holders and to radiate a portion of the drawn thermal energy toward the product.

12. The heater system of claim 11, wherein the thermally conductive bridge includes a thermally conductive insert received in a cavity formed in a radiating element.

13. The heater system of claim 12, wherein the radiating element is integral with the first and second perforated flame holders.

14. A device, comprising:

a housing structure having first and second openings;

a conveyor system configured to carry a product through the housing structure between the first and second openings; and a perforated flame holder positioned within the housing structure, and having a first face, a second face lying opposite the first face, and a plurality of apertures extending through the perforated flame holder between the first and second faces, the perforated flame holder being configured to hold a combustion reaction substantially within the plurality of apertures;

wherein the perforated flame holder is one of a plurality of perforated flame holders positioned within the housing structure, a first one of the plurality of perforated flame holders having a first face lying in a first plane that is not parallel to a plane defined by a transport surface of the conveyor system, and a second one of the plurality of perforated flame holders having a first face lying in a second plane that is not parallel to the plane defined by the transport surface of the conveyor system.

15. The device of claim 14, wherein the plurality of perforated flame holders are configured to radiate thermal energy produced by the combustion reaction.

16. The device of claim 15, wherein a substantial portion of thermal energy is emitted in the form of thermal radiation.

17. The device of claim 16, wherein the plurality of perforated flame holders are positioned such that the product carried by the conveyor system is irradiated by thermal energy emitted by the combustion reaction.

18. The device of claim 14, wherein a third one of the plurality of perforated flame holders has a first face lying in a third plane that is parallel to the plane defined by the transport surface of the conveyor system.

19. The device of claim 14, wherein at least one of the perforated flame holders is positioned with the first face lying in a plane that is substantially perpendicular to a plane defined by a transport surface of the conveyor system.

20. The device of claim 14, wherein the first and second planes are parallel to each other and substantially perpendicular to the plane defined by the transport surface of the conveyor system.

21. The device of claim 14, wherein the first and second ones of the plurality of perforated flame holders are positioned on opposite sides of the conveyor system such that the product carried through the housing structure by the conveyor system passes substantially between the first and second perforated flame holders as it is carried between the first and second openings of the housing structure.

22. The device of claim 14, comprising a convection system configured to circulate, within the housing structure, thermal energy produced by the combustion reaction held by the perforated flame holder.

23. The device of claim 14, wherein the conveyor system comprises a conveyor belt having an upper webbing, the conveyor belt extending beyond the housing structure.

24. The device of claim 14, wherein the conveyor system includes movable carts configured to carry the product through the housing structure between the first and second openings.

25. The device of claim 24, comprising rails extending between the first and second openings of the housing structure, and wherein the movable carts include wheels positioned and configured to engage the tracks and enable movement of the movable carts through the housing structure.

26. A method, comprising:

placing a product piece on a transport surface of a conveyor system;

carrying the product piece into an oven housing by operation of the conveyor system;

supporting a combustion reaction within a plurality of apertures extending through a perforated flame holder;

applying thermal energy produced by the combustion reaction to the product piece as it is carried through the oven housing by the conveyor system; and following the applying thermal energy, carrying the product piece out of the oven housing by further operation of the conveyor system;

wherein the supporting a combustion reaction comprises emitting, toward a first face of the perforated flame holder, a fuel stream from a nozzle positioned with a longitudinal axis thereof lying perpendicular to a plane defined by the first face of the perforated flame holder; and wherein emitting, toward the first face of the perforated flame holder, a fuel stream from a nozzle comprises emitting fuel streams from each of a plurality of nozzles toward respective portions of the first face of the perforated flame holder.

27. A method, comprising:

placing a product piece on a transport surface of a conveyor system;

carrying the product piece into an oven housing by operation of the conveyor system;

supporting a combustion reaction within a plurality of apertures extending through a perforated flame holder;

applying thermal energy produced by the combustion reaction to the product piece as it is carried through the oven housing by the conveyor system; and following the applying thermal energy, carrying the product piece out of the oven housing by further operation of the conveyor system;

wherein the supporting a combustion reaction comprises emitting, toward the first face of the flame holder, a fuel stream from a nozzle positioned with a longitudinal axis thereof lying at an oblique angle relative to a plane defined by a first face of the perforated flame holder.

28. The method of claim 27, wherein the applying thermal energy comprises subjecting the product piece to thermal radiation generated by the combustion reaction.

29. The method of claim 27, wherein the applying thermal energy comprises transferring thermal energy produced by the combustion reaction to the product piece via convection.

30. The method of claim 27, wherein the supporting a combustion reaction comprises emitting, toward a first face of the perforated flame holder, a fuel stream from a nozzle positioned with a longitudinal axis thereof lying perpendicular to a plane defined by the first face of the perforated flame holder.

31. The method of claim 27, wherein the emitting a fuel stream from a nozzle comprises emitting a fuel stream, in an asymmetrical pattern, from the nozzle toward the first face of the perforated flame holder.

32. The method of claim 27, wherein the supporting a combustion reaction comprises emitting, toward respective portions of the first face of the perforated flame holder, a plurality of fuel streams, each from a respective one of a plurality of nozzles positioned with longitudinal axes thereof lying at respective oblique angles relative to a plane defined by a first face of the perforated flame holder.

33. The method of claim 27, wherein the supporting a combustion reaction within a plurality of apertures extending through a perforated flame holder comprises supporting a plurality of combustion reactions, each within a plurality of apertures extending through respective one of a plurality of perforated flame holders.

34. The method of claim 33, wherein the applying thermal energy produced by the combustion reaction to the product piece as it is carried through the oven housing by the conveyor system comprises applying thermal energy produced by the plurality of combustion reactions to the product piece as it is carried through the oven housing.

* * * * *